US009783359B2

(12) United States Patent
D'Amato

(10) Patent No.: US 9,783,359 B2
(45) Date of Patent: Oct. 10, 2017

(54) DOUBLE-WALLED CUP

(75) Inventor: Gianfranco D'Amato, Arzano Naples (IT)

(73) Assignee: Seda S.P.A., Arzano, Napoli (IT)

( * ) Notice: Subject to any disclaimer, the term of this patent is extended or adjusted under 35 U.S.C. 154(b) by 872 days.

(21) Appl. No.: 12/065,953

(22) PCT Filed: Sep. 7, 2006

(86) PCT No.: PCT/EP2006/008753

§ 371 (c)(1),
(2), (4) Date: Jul. 14, 2008

(87) PCT Pub. No.: WO2007/028623

PCT Pub. Date: Mar. 15, 2007

(65) Prior Publication Data

US 2008/0264937 A1 Oct. 30, 2008

(30) Foreign Application Priority Data

Sep. 8, 2005 (DE) ..... 20 2005 014 177

(51) Int. Cl.
*B65D 83/72* (2006.01)
*B65D 81/38* (2006.01)
*B65D 51/28* (2006.01)

(52) U.S. Cl.
CPC ..... *B65D 81/3874* (2013.01); *B65D 51/28* (2013.01); *B65D 81/3869* (2013.01)

(58) Field of Classification Search
USPC ..... 220/592.27, 574.3, 495.03, 23.91, 23.9, 220/62.12, 62.2
See application file for complete search history.

(56) References Cited

U.S. PATENT DOCUMENTS 23,200 A 3/1859 Stimpson
1,031,514 A 7/1912 Bjorkstam
(Continued)

FOREIGN PATENT DOCUMENTS

AR 047625 2/2006
AT 141212 T 8/1996
(Continued)

OTHER PUBLICATIONS

Statement of case in opposition to New Zealand Patent Application No. 543602, Mar. 22, 2007, 79 pages.
(Continued)

*Primary Examiner* — Jeffrey Allen
(74) *Attorney, Agent, or Firm* — Fish & Richardson P.C.

(57) ABSTRACT

The invention relates to a double-walled cup (1) which comprises an inner and an outer wall as well as a cup opening on its upper end and a bottom part on its lower end. The outer wall is substantially produced from paper, cardboard or the like. The object of the invention is to improve said double-walled cup (1) in such a manner that it can be more rapidly and simply produced and assembled and to reduce the structural stability of the double-walled cup while maintaining its corresponding thermal insulating properties. For this purpose, the inner cup providing the inner wall is inserted into the outer cup (3) providing the outer wall and is secured therein or thereto in an especially detachable manner. The inner cup (2) is produced from an at least fluid-tight plastic material.

21 Claims, 3 Drawing Sheets

(56) References Cited

Figure 1:
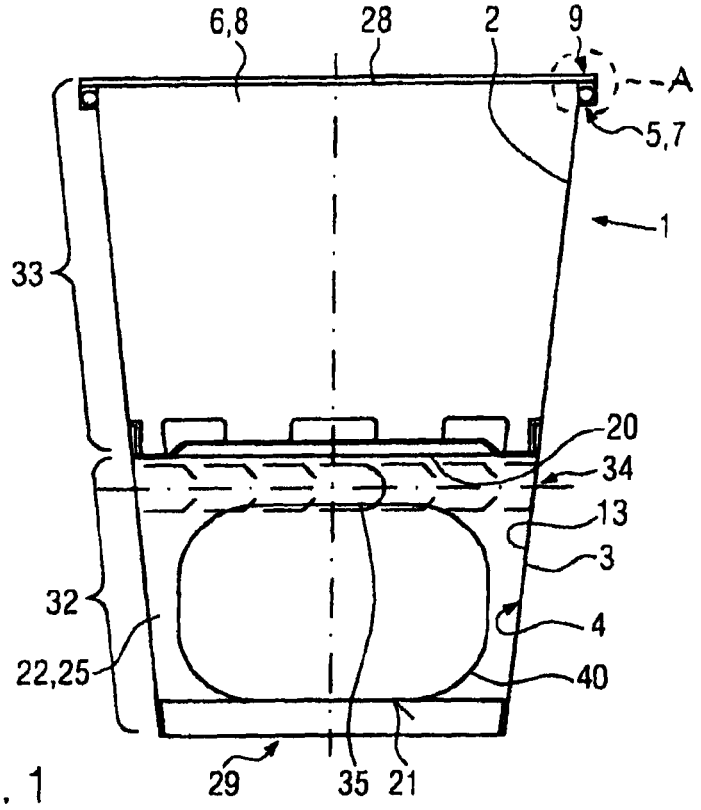

U.S. PATENT DOCUMENTS 1,520,870 A 12/1924 Koch
1,549,417 A 8/1925 Hendrich
1,615,319 A 1/1927 Wynn
1,654,318 A 12/1927 Benson
1,685,494 A 9/1928 Koch
1,706,910 A 3/1929 Wright et al.
1,756,243 A 4/1930 Benson
1,759,407 A 5/1930 Kingsbury
1,814,671 A 7/1931 Dufour
2,053,726 A 9/1936 Marshall
2,134,427 A 10/1938 Biderman
2,156,328 A 5/1939 Barbieri
2,157,054 A 5/1939 Gammeter
2,288,602 A 5/1939 Benton
2,170,060 A 8/1939 Meyer
2,216,331 A 10/1940 Swallow et al.
2,226,340 A 12/1940 Flood
2,235,963 A 3/1941 McGirr et al.
2,240,599 A 5/1941 Amberg
2,266,828 A 12/1941 Sykes
2,416,813 A 3/1947 Barbieri
2,462,497 A 2/1949 Heyman
2,493,633 A 1/1950 Mart
2,540,565 A 2/1951 Barbieri
2,563,352 A 8/1951 Morse
2,591,578 A 4/1952 McNealy et al.
2,661,889 A 12/1953 Phinney
2,666,542 A 1/1954 Price
2,675,954 A 4/1954 Vogel
2,689,424 A 9/1954 Clagett
2,692,722 A 10/1954 Johnson
2,695,744 A 11/1954 Gattuso
2,721,686 A 10/1955 Reifsnyder et al.
2,725,733 A 12/1955 Howlett
2,740,575 A * 4/1956 Fontaine ..... 229/103.1
2,828,903 A 4/1958 Adkins
2,863,585 A 12/1958 Meshberg
2,888,861 A 6/1959 Meyer-Jagenberg
2,899,098 A 8/1959 Gits
2,982,465 A 5/1961 Fallert
3,065,875 A 11/1962 Negoro
3,079,027 A 2/1963 Edwards
3,082,900 A 3/1963 Goodman
3,109,252 A 11/1963 Schellenberg
3,118,351 A 1/1964 Meyer-Jagenberg
3,139,213 A 6/1964 Edwards
RE25,618 E 7/1964 Goodman
3,208,631 A 9/1965 Edwards
3,225,954 A 12/1965 Herrick et al.
3,232,512 A 2/1966 Wanderer
3,298,893 A 1/1967 Allen
3,355,046 A 11/1967 Jolly
3,357,053 A 12/1967 Lyon et al.
3,372,830 A 3/1968 Edwards
3,401,862 A 9/1968 Wanderer
3,428,214 A 2/1969 Leon
3,443,714 A 5/1969 Edwards
3,456,860 A 7/1969 Janninck
3,471,075 A 10/1969 Wolf
3,485,412 A 12/1969 Hawley
3,526,316 A 9/1970 Kalogis
3,531,015 A 9/1970 Makin
3,580,468 A 5/1971 McDevitt
3,583,596 A 6/1971 Brewer
3,612,346 A 10/1971 Schneider et al.
3,645,758 A 2/1972 MacManus
3,700,018 A 10/1972 Goglio
3,737,093 A 6/1973 Amberg et al.
3,739,975 A 6/1973 Davidow
3,747,830 A 7/1973 Goldman
3,749,277 A 7/1973 Kinney
3,765,559 A 10/1973 Sauey et al.
3,766,975 A 10/1973 Todd
D231,068 S 4/1974 Douglas
3,836,207 A 9/1974 Belart
3,846,207 A 11/1974 MacDaniel et al.
3,850,361 A 11/1974 Day et al.
3,878,282 A 4/1975 Bonis et al.
3,884,350 A 5/1975 Johansson
3,908,523 A 9/1975 Shikaya
3,926,361 A 12/1975 Hilderbrand
3,927,766 A 12/1975 Day
3,934,749 A 1/1976 Andrulionis
3,955,697 A 5/1976 Valyi
3,980,107 A 9/1976 Barnes et al.
4,007,670 A 2/1977 Albano et al.
4,018,904 A 4/1977 Muraoka
4,040,537 A 8/1977 Edwards
4,049,122 A 9/1977 Maxwell
4,070,953 A 1/1978 Richards et al.
4,089,358 A 5/1978 Korson
4,102,454 A 7/1978 Karevaara et al.
4,124,120 A 11/1978 Day
4,129,065 A 12/1978 Corse et al.
4,171,085 A 10/1979 Doty
4,187,768 A 2/1980 Suzuki
4,211,024 A 7/1980 Nickell
4,231,476 A 11/1980 Compton et al.
4,261,501 A 4/1981 Watkins et al.
4,292,194 A 9/1981 Perazzoni et al.
4,308,679 A 1/1982 Ray, III et al.
4,318,235 A 3/1982 Augeri
4,324,338 A 4/1982 Beall
4,327,136 A 4/1982 Thompson et al.
4,344,814 A 8/1982 McLaren
4,345,393 A 8/1982 Price et al.
4,368,818 A 1/1983 Day et al.
4,409,045 A 10/1983 Busse
4,409,122 A 10/1983 Kleuskens et al.
4,514,242 A 4/1985 MacLaughlin et al.
4,548,348 A * 10/1985 Clements ..... 220/738
4,551,365 A 11/1985 Bonis
4,560,075 A 12/1985 Lu
4,571,233 A 2/1986 Konzal
4,574,987 A 3/1986 Halligan et al.
4,581,003 A 4/1986 Ito et al.
4,684,553 A 8/1987 Sasaki et al.
4,706,873 A 11/1987 Schulz
4,729,477 A * 3/1988 Growney ..... 206/542
4,771,911 A 9/1988 Morony et al.
4,775,523 A 10/1988 Sparacio et al.
4,789,073 A 12/1988 Fine
4,792,042 A 12/1988 Koehn et al.
4,813,862 A 3/1989 Bowers et al.
4,838,424 A 6/1989 Petzelt
4,850,496 A 7/1989 Rudell et al.
4,863,014 A 9/1989 Summons et al.
4,936,448 A 6/1990 Holloway
4,955,503 A 9/1990 Propes
4,993,580 A 2/1991 Smith
4,997,691 A 3/1991 Parkinson
5,007,578 A 4/1991 Simone
5,021,274 A 6/1991 Beck et al.
5,025,981 A 6/1991 Schellenberg
5,062,568 A 11/1991 Hill et al.
5,076,463 A 12/1991 McGraw
5,078,313 A 1/1992 Matheson et al.
5,092,485 A 3/1992 Lee
5,135,132 A 8/1992 Potochnik
5,145,107 A 9/1992 Silver et al.
5,226,585 A 7/1993 Varano
5,253,781 A 10/1993 Van Melle et al.
5,363,982 A 11/1994 Sadlier
5,385,260 A 1/1995 Gatcomb
5,395,005 A 3/1995 Yoshida
5,425,497 A 6/1995 Sorensen
5,425,498 A 6/1995 Hallam et al.
5,460,323 A 10/1995 Titus
5,484,167 A 1/1996 Donaldson et al.
5,489,063 A 2/1996 Buchalski et al.
5,524,817 A 6/1996 Meier et al.
5,542,599 A 8/1996 Sobol
5,547,124 A 8/1996 Mueller
5,551,592 A 9/1996 Barton et al.

(56) References Cited

U.S. PATENT DOCUMENTS 5,553,735 A 9/1996 Kimura
5,573,141 A 11/1996 Chen
5,586,689 A 12/1996 D'Amato et al.
5,593,053 A 1/1997 Kaufman et al.
5,603,450 A 2/1997 Whitnell
5,628,453 A 5/1997 MacLaughlin
5,660,326 A 8/1997 Varano et al.
5,660,898 A 8/1997 Calvert
5,671,353 A 9/1997 Tian et al.
5,674,546 A 10/1997 Barnes et al.
5,678,725 A 10/1997 Yamada et al.
5,685,480 A 11/1997 Choi
5,697,550 A 12/1997 Varano et al.
5,713,512 A 2/1998 Barrett
5,752,653 A 5/1998 Razzaghi
RE35,830 E 6/1998 Sadlier
5,769,262 A 6/1998 Yamada et al.
5,769,311 A 6/1998 Morita et al.
5,772,111 A 6/1998 Kirsch
5,794,843 A 8/1998 Sanchez
5,820,016 A 10/1998 Stropkay
5,823,948 A 10/1998 Ross, Jr. et al.
5,839,599 A 11/1998 Lin
5,839,653 A 11/1998 Zadravetz
5,894,948 A 4/1999 Yeh
5,903,889 A 5/1999 de la Huerga et al.
5,913,449 A 6/1999 Branch et al.
5,918,761 A 7/1999 Wissinger
5,944,208 A 8/1999 Gale
5,950,917 A 9/1999 Smith
5,953,419 A 9/1999 Lohstroh et al.
5,954,217 A 9/1999 Brkovic et al.
5,956,400 A 9/1999 Chaum et al.
5,964,400 A 10/1999 Varano et al.
5,975,344 A 11/1999 Stevens
5,996,887 A 12/1999 Cai et al.
6,036,801 A 3/2000 Yamada et al.
6,047,488 A 4/2000 Tuszkiewicz
6,050,443 A 4/2000 Tung
6,056,144 A 5/2000 Strange et al.
6,065,632 A 5/2000 Moore, Jr.
6,068,181 A 5/2000 Cai
6,076,699 A 6/2000 Seager et al.
6,085,970 A 7/2000 Sadlier
6,109,518 A 8/2000 Mueller et al.
6,116,503 A 9/2000 Varano
6,126,584 A 10/2000 Zadravetz
6,145,656 A * 11/2000 Marco ..... 206/147
6,148,342 A 11/2000 Ho
6,161,720 A 12/2000 Castle
6,193,098 B1 2/2001 Mochizuki et al.
6,196,454 B1 3/2001 Sadlier
6,210,766 B1 4/2001 McLaughlin
6,224,954 B1 5/2001 Mitchell et al.
6,237,845 B1 5/2001 Hashimoto et al.
6,253,995 B1 7/2001 Blok et al.
6,257,485 B1 7/2001 Sadlier et al.
6,260,021 B1 7/2001 Wong et al.
6,260,756 B1 7/2001 Mochizuki et al.
6,263,330 B1 7/2001 Bessette et al.
6,265,040 B1 7/2001 Neale et al.
6,286,754 B1 9/2001 Stier et al.
6,287,247 B1 9/2001 Dees et al.
6,315,150 B1 11/2001 Takai et al.
6,315,192 B1 11/2001 Marlow
6,332,538 B1 12/2001 Pritchard
6,343,735 B1 2/2002 Cai
6,367,652 B1 4/2002 Toida et al.
6,378,763 B1 4/2002 Nelson et al.
6,378,766 B2 4/2002 Sadlier
6,382,449 B1 5/2002 Kazmierski et al.
6,401,955 B1 6/2002 Yang
6,419,108 B1 7/2002 Toida et al.
6,422,456 B1 7/2002 Sadlier
6,424,996 B1 7/2002 Killcommons et al.
6,449,621 B1 9/2002 Pettovello
6,457,585 B1 10/2002 Huffer et al.
6,463,417 B1 10/2002 Schoenberg
6,557,102 B1 4/2003 Wong et al.
6,557,751 B2 5/2003 Puerini
6,562,270 B1 * 5/2003 Gannon et al. ..... 264/239
6,568,587 B1 5/2003 Yamada et al.
6,574,629 B1 6/2003 Cooke, Jr. et al.
6,574,742 B1 6/2003 Jamroga et al.
6,598,786 B1 7/2003 Guo
6,611,846 B1 8/2003 Stoodley et al.
6,612,456 B1 9/2003 Hundley et al.
6,648,176 B1 11/2003 Donovan
6,651,060 B1 11/2003 Harper et al.
6,663,926 B1 12/2003 Okushita et al.
6,678,703 B2 1/2004 Rothschild et al.
6,678,764 B2 1/2004 Parvulescu et al.
6,688,487 B2 2/2004 Oakes et al.
6,691,134 B1 2/2004 Babula et al.
6,738,798 B1 5/2004 Ploetz et al.
6,746,743 B2 6/2004 Knoerzer et al.
6,749,913 B2 6/2004 Watanabe et al.
6,763,344 B1 7/2004 Osentoski et al.
6,775,670 B2 8/2004 Bessette et al.
6,811,843 B2 11/2004 DeBraal et al.
6,852,381 B2 2/2005 DeBraal et al.
6,908,651 B2 6/2005 Watanabe et al.
6,921,179 B2 7/2005 Diak Ghanem
6,926,197 B2 8/2005 Hed et al.
6,989,198 B2 1/2006 Masuda et al.
7,100,770 B2 9/2006 D'Amato et al.
7,117,579 B2 10/2006 Schellenberg
7,172,086 B2 2/2007 McKendry et al.
7,175,585 B2 2/2007 Okushita et al.
7,195,805 B2 3/2007 Breining et al.
D546,625 S 7/2007 Gluck
D547,122 S 7/2007 Gluck
D550,033 S 9/2007 Bodum
D550,034 S 9/2007 Bodum
D551,502 S 9/2007 Bodum
D553,437 S 10/2007 Bodum
D553,439 S 10/2007 Bodum
D553,440 S 10/2007 Bodum
D553,442 S 10/2007 Bodum
D553,909 S 10/2007 Bodum
D553,910 S 10/2007 Bodum
D553,911 S 10/2007 Bodum
7,281,650 B1 10/2007 Milan
D557,561 S 12/2007 Flowers et al.
D557,563 S 12/2007 Bodum
D557,564 S 12/2007 Bodum
7,306,113 B2 12/2007 El-Saden et al.
D562,075 S 2/2008 Mehta
D563,172 S 3/2008 Bodum
7,344,038 B2 3/2008 Elansary
D577,260 S 9/2008 Bodum
7,451,910 B2 11/2008 Frost et al.
7,451,911 B2 11/2008 Stepanek, Jr.
D581,738 S 12/2008 Bodum
D581,739 S 12/2008 Bodum
7,458,504 B2 12/2008 Robertson et al.
7,481,356 B2 1/2009 Stahlecker et al.
7,536,767 B2 5/2009 Hollis et al.
D594,277 S 6/2009 Snell
D595,090 S 6/2009 Benson
7,552,841 B2 6/2009 Hollis et al.
D597,791 S 8/2009 Lion et al.
D597,792 S 8/2009 Lion et al.
7,597,246 B2 10/2009 Stepanek, Jr.
7,631,781 B2 12/2009 Chen
7,677,436 B2 3/2010 Ohno et al.
7,694,843 B2 4/2010 Hollis et al.
7,699,216 B2 4/2010 Smith et al.
7,717,325 B2 5/2010 Puls et al.
2001/0013537 A1 8/2001 Sadlier
2001/0032100 A1 10/2001 Mahmud et al.
2001/0041991 A1 11/2001 Segal et al.
2002/0010679 A1 1/2002 Felsher
2002/0043555 A1 4/2002 Mader

(56) References Cited

U.S. PATENT DOCUMENTS

| | | | |
|---|---|---|---|
| 2002/0148832 | A1 | 10/2002 | Breining et al. |
| 2002/0156650 | A1 | 10/2002 | Klein et al. |
| 2002/0172818 | A1 | 11/2002 | DeBraal et al. |
| 2003/0029876 | A1 | 2/2003 | Giraud |
| 2003/0088441 | A1 | 5/2003 | McNerney |
| 2003/0116576 | A1 | 6/2003 | Lang-Boecker |
| 2003/0121189 | A1 | 7/2003 | Williams |
| 2003/0121963 | A1 | 7/2003 | Van Handel |
| 2003/0140044 | A1 | 7/2003 | Mok et al. |
| 2003/0226882 | A1 | 12/2003 | Porchia et al. |
| 2004/0034550 | A1 | 2/2004 | Menschik et al. |
| 2004/0069311 | A1 | 4/2004 | Sasaki et al. |
| 2004/0094612 | A1 | 5/2004 | D'Amato |
| 2004/0112949 | A1 | 6/2004 | Hed et al. |
| 2004/0133797 | A1 | 7/2004 | Arnold |
| 2004/0139222 | A1 | 7/2004 | Slik et al. |
| 2004/0154156 | A1 | 8/2004 | Schellenberg |
| 2004/0199765 | A1 | 10/2004 | Kohane et al. |
| 2004/0226948 | A1 | 11/2004 | Okushita et al. |
| 2005/0006385 | A1 | 1/2005 | D'Amato |
| 2005/0029337 | A1 | 2/2005 | Van Handel |
| 2005/0040218 | A1 | 2/2005 | Hinchey et al. |
| 2005/0045643 | A1 | 3/2005 | Ghanem |
| 2005/0115975 | A1 | 6/2005 | Smith et al. |
| 2005/0184074 | A1 | 8/2005 | Simmons et al. |
| 2005/0199697 | A1 | 9/2005 | Nugent |
| 2005/0205651 | A1 | 9/2005 | Marx |
| 2005/0236468 | A1 | 10/2005 | Sadlier |
| 2005/0258225 | A1 | 11/2005 | Martin |
| 2005/0269390 | A1 | 12/2005 | Martin |
| 2006/0038001 | A1 | 2/2006 | Stepanek |
| 2006/0118608 | A1 | 6/2006 | Stahlecker |
| 2006/0131316 | A1 | 6/2006 | Bresler |
| 2006/0144915 | A1 | 7/2006 | Sadlier |
| 2006/0186012 | A1 | 8/2006 | D'Amato |
| 2006/0226210 | A1 | 10/2006 | Stahlecker |
| 2006/0237465 | A1 | 10/2006 | D'Amato |
| 2006/0283855 | A1 | 12/2006 | Hollis et al. |
| 2006/0289610 | A1 | 12/2006 | Kling |
| 2007/0262129 | A1 | 11/2007 | Zadravetz |
| 2007/0284426 | A1 | 12/2007 | Lo |
| 2008/0006643 | A1 | 1/2008 | Ma |
| 2008/0023536 | A1 | 1/2008 | Frost et al. |
| 2008/0023537 | A1 | 1/2008 | Frost et al. |
| 2008/0023538 | A1 | 1/2008 | Robertson et al. |
| 2008/0029588 | A1 | 2/2008 | Messerschmid et al. |
| 2008/0078825 | A1 | 4/2008 | Puls et al. |
| 2008/0087677 | A1 | 4/2008 | Robertson et al. |
| 2008/0087715 | A1 | 4/2008 | Robertson et al. |
| 2008/0087716 | A1 | 4/2008 | Sadlier |
| 2008/0093434 | A1 | 4/2008 | Van Handel |
| 2008/0105692 | A1 | 5/2008 | Hiromori |
| 2008/0105693 | A1 | 5/2008 | Hechmati |
| 2008/0121681 | A1 | 5/2008 | Wiedmeyer |
| 2008/0128433 | A1 | 6/2008 | Stauffer et al. |
| 2008/0128481 | A1 | 6/2008 | Robertson |
| 2008/0156857 | A1 | 7/2008 | Johnston |
| 2008/0169297 | A1 | 7/2008 | Kelly |
| 2008/0264937 | A1 | 10/2008 | D'Amato |
| 2008/0272118 | A1 | 11/2008 | Wang |
| 2008/0280743 | A1 | 11/2008 | Stahlecker et al. |
| 2008/0302800 | A1 | 12/2008 | Chou |
| 2008/0308620 | A1 | 12/2008 | Stepanek, Jr. |
| 2008/0314909 | A1 | 12/2008 | Takeo et al. |
| 2009/0020597 | A1 | 1/2009 | D'Amato |
| 2009/0110782 | A1 | 4/2009 | Mellor |
| 2009/0121007 | A1 | 5/2009 | Van Handel |
| 2009/0159653 | A1 | 6/2009 | Stahlecker |
| 2009/0166402 | A1 | 7/2009 | D'amato |
| 2009/0170680 | A1 | 7/2009 | D'amato |
| 2009/0184020 | A1 | 7/2009 | Messerschmid et al. |
| 2009/0218390 | A1 | 9/2009 | Chang |
| 2009/0230178 | A1 | 9/2009 | Stahlecker et al. |
| 2009/0294456 | A1 | 12/2009 | Messerschmid |
| 2009/0294520 | A1 | 12/2009 | Stepanek, Jr. |
| 2009/0321440 | A1 | 12/2009 | Fedusa et al. |
| 2009/0321508 | A1 | 12/2009 | Fu et al. |
| 2010/0025283 | A1 | 2/2010 | Oshima et al. |
| 2010/0044424 | A1 | 2/2010 | Van Handel |
| 2010/0065622 | A1 | 3/2010 | Chang |
| 2010/0072268 | A1 | 3/2010 | Johnson et al. |
| 2010/0160130 | A1 | 6/2010 | Messerschmid |
| 2010/0187296 | A1 | 7/2010 | Puls et al. |

FOREIGN PATENT DOCUMENTS

| | | | |
|---|---|---|---|
| AT | 263709 | T | 4/2004 |
| AU | 4557993 | A | 3/1994 |
| AU | 2008264158 | A1 | 8/2009 |
| AU | 2009200641 | A1 | 10/2009 |
| BE | 410215 | A | 7/1935 |
| BE | 897862 | A1 | 3/1984 |
| BR | PI0900078 | A2 | 9/2009 |
| CA | 742539 | | 9/1966 |
| CA | 837922 | | 3/1970 |
| CA | 844949 | | 6/1970 |
| CA | 1007182 | | 3/1977 |
| CA | 1082657 | | 7/1980 |
| CA | 1125680 | | 6/1982 |
| CA | 1125681 | | 6/1982 |
| CA | 1152011 | | 8/1983 |
| CA | 1239885 | | 8/1988 |
| CA | 1249232 | | 1/1989 |
| CA | 1257209 | | 7/1989 |
| CA | 2021035 | A1 | 1/1991 |
| CA | 2026197 | | 8/1991 |
| CA | 2060135 | | 7/1992 |
| CA | 2150306 | | 2/1996 |
| CA | 2043958 | | 7/1996 |
| CA | 2250677 | | 4/2000 |
| CA | 2286498 | A1 | 4/2000 |
| CA | 2176080 | | 8/2001 |
| CA | 2228749 | | 10/2001 |
| CA | 2141730 | | 5/2002 |
| CA | 2197976 | | 5/2002 |
| CA | 2432791 | | 6/2002 |
| CA | 2165509 | | 7/2002 |
| CA | 2436505 | A1 | 8/2002 |
| CA | 2233356 | | 11/2002 |
| CA | 2431542 | | 12/2002 |
| CA | 2431869 | | 12/2002 |
| CA | 2219845 | | 4/2003 |
| CA | 2244689 | | 9/2003 |
| CA | 2271581 | | 12/2003 |
| CA | 2121491 | | 7/2004 |
| CA | 2542905 | A1 | 1/2005 |
| CA | 2564012 | | 11/2005 |
| CA | 114070 | | 2/2006 |
| CA | 2520024 | | 3/2006 |
| CA | 2262802 | | 6/2006 |
| CA | 2549450 | | 12/2006 |
| CA | 2608826 | | 12/2006 |
| CA | 2262458 | | 1/2007 |
| CA | 2613109 | | 1/2007 |
| CA | 2621453 | | 3/2007 |
| CA | 113773 | | 4/2007 |
| CA | 119089 | | 5/2007 |
| CA | 119090 | | 5/2007 |
| CA | 119091 | | 5/2007 |
| CA | 119092 | | 5/2007 |
| CA | 2629190 | | 5/2007 |
| CA | 118452 | | 7/2007 |
| CA | 113355 | | 9/2007 |
| CA | 115931 | | 10/2007 |
| CA | 116240 | | 10/2007 |
| CA | 116241 | | 10/2007 |
| CA | 116438 | | 10/2007 |
| CA | 119239 | | 10/2007 |
| CA | 120446 | | 10/2007 |
| CA | 2545497 | | 11/2007 |
| CA | 2588413 | | 11/2007 |
| CA | 2657721 | A1 | 1/2008 |
| CA | 116480 | | 2/2008 |
| CA | 2598153 | | 2/2008 |

(56) References Cited

FOREIGN PATENT DOCUMENTS

| | | | |
|---|---|---|---|
| CA | 120610 | | 3/2008 |
| CA | 2520677 | | 4/2008 |
| CA | 2664625 | | 4/2008 |
| CA | 2665633 | | 4/2008 |
| CA | 114549 | | 5/2008 |
| CA | 121962 | | 5/2008 |
| CA | 2610053 | | 5/2008 |
| CA | 122120 | | 6/2008 |
| CA | 122879 | | 7/2008 |
| CA | 2267361 | | 10/2008 |
| CA | 2598691 | | 5/2009 |
| CA | 2347777 | | 7/2009 |
| CA | 2706374 | | 7/2009 |
| CA | 2311825 | | 10/2009 |
| CA | 2405786 | | 11/2009 |
| CA | 2394475 | | 1/2010 |
| CA | 128485 | | 2/2010 |
| CH | 678938 | A5 | 11/1991 |
| CN | 1082987 | A | 3/1994 |
| CN | 1128744 | A | 8/1996 |
| CN | 1237133 | A | 12/1999 |
| CN | 1272089 | A | 11/2000 |
| CN | 1288427 | A | 3/2001 |
| CN | 2430371 | | 5/2001 |
| CN | 2484866 | Y | 4/2002 |
| CN | 2526274 | Y | 12/2002 |
| CN | 1489541 | A | 4/2004 |
| CN | 1781813 | A | 6/2006 |
| CN | 101489771 | A | 7/2009 |
| CN | 101492107 | A | 7/2009 |
| CN | 101531070 | A | 9/2009 |
| DE | 652737 | C | 11/1937 |
| DE | 18806777 | | 5/1963 |
| DE | 1191285 | | 4/1965 |
| DE | 2001499 | | 7/1970 |
| DE | 8301046.7 | | 6/1983 |
| DE | 3335833 | A1 | 4/1984 |
| DE | 9115069 | U1 | 1/1992 |
| DE | 9215015 | U1 | 1/1993 |
| DE | 59002814 | | 10/1993 |
| DE | 4226313 | | 2/1994 |
| DE | 4393650 | | 11/1995 |
| DE | 4421870 | | 1/1996 |
| DE | 59303454 | | 9/1996 |
| DE | 19517394 | | 11/1996 |
| DE | 19840841 | | 3/2000 |
| DE | 19840841 | A1 | 3/2000 |
| DE | 10056811 | A1 | 7/2001 |
| DE | 10054727 | A1 | 5/2002 |
| DE | 20110390 | | 10/2002 |
| DE | 20310623 | U1 | 11/2003 |
| DE | 60102661 | T2 | 8/2004 |
| DE | 102004056932 | A1 | 5/2006 |
| DE | 102005017741 | A1 | 10/2006 |
| DE | 102006025612 | A1 | 11/2007 |
| DE | 102007024243 | A1 | 1/2008 |
| DE | 102007024254 | A1 | 1/2008 |
| DE | 102007030864 | A1 | 1/2008 |
| DE | 102008005403 | A1 | 7/2009 |
| DE | 102008014878 | A1 | 9/2009 |
| EA | 200900031 | A1 | 8/2009 |
| EP | 0074936 | A2 | 3/1983 |
| EP | 0 108 264 | | 10/1983 |
| EP | 0102149 | A2 | 3/1984 |
| EP | 0 371 918 | | 6/1990 |
| EP | 0408515 | A1 | 1/1991 |
| EP | 0512179 | A1 | 11/1992 |
| EP | 0653983 | A1 | 5/1995 |
| EP | 0 659 647 | | 6/1995 |
| EP | 0 683 033 | | 11/1995 |
| EP | 0 688 720 | | 12/1995 |
| EP | 0 695 692 | | 2/1996 |
| EP | 0 765 821 | | 4/1997 |
| EP | 0 812 668 | | 12/1997 |
| EP | 0929455 | | 7/1999 |
| EP | 0934202 | A1 | 8/1999 |
| EP | 0 940 240 | | 9/1999 |
| EP | 1 029 656 | | 8/2000 |
| EP | 1031514 | | 8/2000 |
| EP | 1 060 879 | | 12/2000 |
| EP | 1057733 | A1 | 12/2000 |
| EP | 1 157 943 | | 11/2001 |
| EP | 1203728 | A2 | 5/2002 |
| EP | 1 227 042 | | 7/2002 |
| EP | 1227042 | A1 | 7/2002 |
| EP | 1227043 | A1 | 7/2002 |
| EP | 1 254 842 | | 11/2002 |
| EP | 1 317 380 | | 6/2003 |
| EP | 1 349 789 | | 10/2003 |
| EP | 1 404 580 | | 4/2004 |
| EP | 1 404 590 | | 4/2004 |
| EP | 1 418 272 | | 5/2004 |
| EP | 1 463 670 | | 10/2004 |
| EP | 1479512 | A2 | 11/2004 |
| EP | 1 486 424 | | 12/2004 |
| EP | 1 512 527 | | 3/2005 |
| EP | 1 547 762 | | 6/2005 |
| EP | 1 637 457 | | 3/2006 |
| EP | 1 656 300 | | 5/2006 |
| EP | 1 670 688 | | 6/2006 |
| EP | 1 687 213 | | 8/2006 |
| EP | 1 699 326 | | 9/2006 |
| EP | 1712490 | A2 | 10/2006 |
| EP | 1714912 | | 10/2006 |
| EP | 1 719 715 | | 11/2006 |
| EP | 1 739 029 | | 1/2007 |
| EP | 1 744 964 | | 1/2007 |
| EP | 1785370 | A1 | 5/2007 |
| EP | 1 876 106 | | 1/2008 |
| EP | 1 625 079 | | 2/2008 |
| EP | 1 894 847 | | 3/2008 |
| EP | 1 921 023 | | 5/2008 |
| EP | 1 939 099 | | 7/2008 |
| EP | 1975083 | A2 | 10/2008 |
| EP | 1 990 184 | | 11/2008 |
| EP | 2 128 041 | | 1/2009 |
| EP | 2 049 325 | | 4/2009 |
| EP | 2 049 326 | | 4/2009 |
| EP | 2043853 | A1 | 4/2009 |
| EP | 2080715 | A1 | 7/2009 |
| EP | 2108506 | A2 | 10/2009 |
| EP | 2 147 871 | | 1/2010 |
| EP | 2 199 222 | | 6/2010 |
| EP | 2 202 178 | | 6/2010 |
| EP | 2 238046 | | 10/2010 |
| ES | 2045882 | T3 | 1/1994 |
| ES | 2093443 | T3 | 12/1996 |
| ES | 2218361 | T3 | 11/2004 |
| FR | 791981 | A | 12/1935 |
| FR | 14 90 636 | | 6/1967 |
| FR | 2160489 | A1 | 6/1973 |
| FR | 2 533 894 | A1 | 4/1984 |
| FR | 2825981 | | 6/2001 |
| FR | 2813861 | A1 | 3/2002 |
| GB | 321176 | A | 10/1929 |
| GB | 0445661 | A | 4/1936 |
| GB | 484990 | A | 5/1938 |
| GB | 1261531 | | 1/1972 |
| GB | 1261532 | | 1/1972 |
| GB | 1261533 | | 1/1972 |
| GB | 2 016 640 | | 9/1979 |
| GB | 1 554 241 | | 10/1979 |
| GB | 2 044 076 | | 10/1980 |
| GB | 2 055 737 | | 3/1981 |
| GB | 2 061 699 | | 5/1981 |
| GB | 2 073 581 | | 10/1981 |
| GB | 2074124 | A | 10/1981 |
| GB | 2 077 177 | | 12/1981 |
| GB | 2 078 094 | | 1/1982 |
| GB | 2130168 | A | 5/1984 |
| GB | 2333087 | A | 7/1999 |
| GB | 2 359 295 | | 8/2001 |
| GB | 2420267 | | 5/2006 |
| GB | 2425041 | A | 10/2006 |

(56) References Cited

FOREIGN PATENT DOCUMENTS

| | | | |
|---|---|---|---|
| GB | 2426045 | A | 11/2006 |
| GB | 2445287 | A | 7/2008 |
| HK | 1034700 | A1 | 4/2004 |
| HK | 1063172 | A1 | 8/2006 |
| IT | 1366725 | | 2/2006 |
| IT | MI0020060589 | | 6/2006 |
| JP | 50-67002 | | 10/1948 |
| JP | 52-76459 | | 11/1950 |
| JP | 50052003 | A | 5/1975 |
| JP | 50120802 | A | 10/1975 |
| JP | 51-140989 | | 12/1976 |
| JP | 53-060441 | | 5/1978 |
| JP | 55134046 | | 10/1980 |
| JP | 56156777 | A | 11/1981 |
| JP | 58-81159 | | 5/1983 |
| JP | 59-94076 | | 5/1984 |
| JP | 60-154235 | | 8/1985 |
| JP | 60-242490 | | 12/1985 |
| JP | 62-143663 | | 6/1987 |
| JP | 2509655 | Y2 | 8/1989 |
| JP | 2-307738 | | 12/1990 |
| JP | 3023014 | U | 3/1991 |
| JP | 4-032908 | | 2/1992 |
| JP | 4097833 | | 3/1992 |
| JP | 04097833 | A | 3/1992 |
| JP | 4-45215 | | 4/1992 |
| JP | 4-68848 | | 6/1992 |
| JP | 5-84621 | | 11/1993 |
| JP | 06048474 | A | 2/1994 |
| JP | 07-149338 | | 6/1995 |
| JP | 8-207924 | | 8/1996 |
| JP | 8-310571 | | 11/1996 |
| JP | 9-132224 | | 5/1997 |
| JP | 10-175627 | | 6/1998 |
| JP | 10-278931 | | 10/1998 |
| JP | 10-338277 | | 12/1998 |
| JP | 11314286 | | 11/1999 |
| JP | 11321936 | A | 11/1999 |
| JP | 11342982 | A | 12/1999 |
| JP | 2000033931 | | 2/2000 |
| JP | 2000095228 | | 4/2000 |
| JP | 2000103478 | | 4/2000 |
| JP | 2000103479 | | 4/2000 |
| JP | 2000118520 | | 4/2000 |
| JP | 2000-203664 | | 7/2000 |
| JP | 3063644 | | 7/2000 |
| JP | 2000190943 | | 7/2000 |
| JP | 2000203664 | | 7/2000 |
| JP | 2000-238739 | | 9/2000 |
| JP | 2000-281044 | | 10/2000 |
| JP | 2000281044 | | 10/2000 |
| JP | 2001-2051 | | 1/2001 |
| JP | 01-98355 | | 4/2001 |
| JP | 2001097355 | | 4/2001 |
| JP | 2001171642 | | 6/2001 |
| JP | 2001180647 | | 7/2001 |
| JP | 2001293802 | | 10/2001 |
| JP | 2001294282 | | 10/2001 |
| JP | 3248718 | A | 2/2002 |
| JP | 3274412 | A | 4/2002 |
| JP | 2002-128049 | | 5/2002 |
| JP | 2003276721 | | 10/2003 |
| JP | 2004090928 | A | 3/2004 |
| JP | 2004090929 | | 3/2004 |
| JP | 2004-1892 | | 4/2004 |
| JP | 2004-98663 | | 4/2004 |
| JP | 2004-99079 | | 4/2004 |
| JP | 2004522654 | T | 7/2004 |
| JP | 2004-314987 | | 11/2004 |
| JP | 2004-315065 | A | 11/2004 |
| JP | 2006143331 | A | 6/2006 |
| JP | 2008-529549 | | 8/2008 |
| JP | 2009173346 | A | 8/2009 |
| KR | 2006056859 | | 5/2006 |
| NL | 42544 | C | 2/1938 |
| NZ | 506739 | | 11/2001 |
| NZ | 519160 | | 12/2003 |
| SG | 0117419 | A1 | 12/2005 |
| TR | 200400866 | T4 | 6/2004 |
| TW | 393427 | B | 6/2000 |
| TW | 399609 | Y | 7/2000 |
| WO | 93/08084 | | 4/1993 |
| WO | 9403326 | A1 | 2/1994 |
| WO | 9832601 | A2 | 7/1998 |
| WO | 9911526 | A1 | 3/1999 |
| WO | 9922686 | A1 | 5/1999 |
| WO | 9959883 | A1 | 11/1999 |
| WO | 0017058 | A1 | 3/2000 |
| WO | 0028288 | A1 | 5/2000 |
| WO | WO 01/38180 | | 5/2001 |
| WO | WO-0204300 | | 1/2002 |
| WO | WO 02/30783 | | 4/2002 |
| WO | 0247523 | A1 | 6/2002 |
| WO | WO 02/49924 | | 6/2002 |
| WO | WO-02060767 | | 8/2002 |
| WO | WO-03057577 | | 7/2003 |
| WO | WO 2004/103845 | | 12/2004 |
| WO | WO 2005/012114 | | 2/2005 |
| WO | WO 2005/047126 | | 5/2005 |
| WO | 2005054082 | A1 | 6/2005 |
| WO | WO 2005/053487 | | 6/2005 |
| WO | 2005075319 | A1 | 8/2005 |
| WO | 2005100167 | A1 | 10/2005 |
| WO | WO 2005/102847 | | 11/2005 |
| WO | 2007028623 | A1 | 3/2007 |
| WO | WO 2007/036928 | | 4/2007 |
| WO | 2007054179 | A2 | 5/2007 |
| WO | 2007054318 | A1 | 5/2007 |
| WO | WO 2007/078446 | | 7/2007 |
| WO | WO 2007/090415 | | 8/2007 |
| WO | WO 2007/091068 | | 8/2007 |
| WO | WO 2007/094838 | | 8/2007 |
| WO | WO 2007/126783 | | 11/2007 |
| WO | 2008009371 | A1 | 1/2008 |
| WO | 2008009372 | A1 | 1/2008 |
| WO | WO 2008/009372 | | 1/2008 |
| WO | WO 2008/014230 | | 1/2008 |
| WO | WO 2008/809371 | | 1/2008 |
| WO | WO 2008/022180 | | 2/2008 |
| WO | WO 2008/026161 | | 3/2008 |
| WO | WO 2008/042378 | | 4/2008 |
| WO | WO 2008/045708 | | 4/2008 |
| WO | WO 2008/045944 | | 4/2008 |
| WO | 2008067865 | A1 | 6/2008 |
| WO | WO 2008/107657 | | 9/2008 |
| WO | WO 2008/119938 | | 10/2008 |
| WO | WO 2008/123783 | | 10/2008 |
| WO | WO 2008/146115 | | 12/2008 |
| WO | 2009/021305 | | 2/2009 |
| WO | WO 2009/021305 | | 2/2009 |
| WO | WO 2009/032837 | | 3/2009 |
| WO | WO 2009/034323 | | 3/2009 |
| WO | WO 2009/039632 | | 4/2009 |
| WO | WO 2009/059352 | | 5/2009 |
| WO | WO 2009/074285 | | 6/2009 |
| WO | 2009092557 | A1 | 7/2009 |
| WO | WO 2009/082660 | | 7/2009 |
| WO | WO 2009/092557 | | 7/2009 |
| WO | WO 2009/118772 | | 10/2009 |
| WO | WO 2010/008629 | | 1/2010 |
| WO | WO 2010/011627 | | 1/2010 |
| WO | WO 2010/019146 | | 2/2010 |
| WO | WO 2010/031764 | | 3/2010 |
| WO | WO 2010/034869 | | 4/2010 |
| WO | WO 2010/036645 | | 4/2010 |
| WO | WO 2010/067047 | | 6/2010 |

OTHER PUBLICATIONS

Statement of case in support of Notice of Opposition to Grant of Patent (Section 21) in New Zealand Patent Application No. 543602, dated Mar. 28, 2007, 16 pages.

(56) References Cited

OTHER PUBLICATIONS

International Search Report from International Application No. PCT/EP2006/009933, dated Oct. 4, 2007, 5 pages.
International Search Report dated Jan. 15, 2007 in PCT/EP2006/008753.
International Search Report from Corresponding International Application No. PCT/EP2005/005406, dated Aug. 25, 2005, 2 pages.
Search Report for DE 203 19 691.0 dated Aug. 24, 2004.
An Office Action dated Jul. 1, 2011, which issued in corresponding Mexican Application No. MX/a/2008/003214.
Second Office Action from the State Intellectual Property Office of P.R. China, dated Mar. 21, 2011, for Appln. No. 200480025553.7, issued as 2011031600528500.
Request for Inter Partes Reexamination Under 35 U.S.C. § 331 and 37 C.F.R. §1.913 directed to U.S. Pat. No. 7,481,356, filed Jun. 4, 2010 (assigned U.S. Appl. No. 95/001,370).
Order Granting/Denying Request for Inter Partes Reexamination in Reexamination Serial No. 95/001,370, dated Jul. 23, 2010.
Office Action in Inter Partes Reexamination in Reexamination Serial No. 95/001,370, dated Jul. 23, 2011.
Response to Office Action in Reexamination Serial No. 95/001,370, dated Sep. 22, 2010.
Third Party Requester Seda S.P.A. Comments After Patent Owner Response Pursuant to 37 C.F.R. §1.947 in Reexamination Serial No. 95/001,370, filed Oct. 21, 2010.
Action Closing Prosecution in Reexamination Serial No. 95/001,370, dated Jan. 7, 2011.
Right of Appeal Notice in Reexamination Serial No. 95/001,370, dated Apr. 25, 2011.
European Search Report dated Sep. 30, 2010, based on EP10008013.
European Search Report dated Sep. 30, 2010, based on EP10008011.
European Search Report dated Sep. 30, 2010, based on EP10008012.
An Office Action dated Aug. 11, 2011, which issued in corresponding Chinese Application No. 200680032931.3.
Decision—Minutes of the oral proceedings before the Opposition Division in EP-B-1785370.
EPO Communication dated Oct. 20, 2010, based on EP1976683.
Notice of Reasons for Rejection from the Japanese Patent Office in Japanese Patent Appln. No. 2008-539346.

* cited by examiner

DOUBLE-WALLED CUP

RELATED APPLICATIONS

This application is a nationalization of PCT application No. PCT/EP2006/008753 filed on Sep. 7, 2006, claiming priority based on German No. 202005014177.1 filed on Sep. 8, 2005, the contents of which are incorporated herein by reference in their entirety.

The invention relates to a double-walled cup with an inner and outer wall, wherein at its upper end the cup has a cup opening and at its lower end a bottom part. At least the outer wall is essentially made from paper, cardboard or the like.

A double-walled cup of this nature is known from EP 1 227 043. With this design the outer wall is formed by a sleeve, which is generally pushed from below onto an inner cup forming the inner wall. The sleeve forming the outer wall is attached to the inner cup at its upper end and at its lower end, wherein an air gap is formed between the sleeve and the inner cup, which provides thermal insulation for the double-walled cup.

A double-walled cup of this nature exhibits good insulating properties, so that it can be well used both for storing and extracting a warm or hot drink and for storing and extracting a cooled drink or the like. The inner cup is similarly manufactured from paper, cardboard or the like, wherein at least the inner cup has in addition a fluid-tight coating on its inner side.

The object of the present invention is to improve a double-walled cup of this nature such that it can be more rapidly and simply produced and assembled whilst maintaining the appropriate thermal insulation properties and at the same time the structure of the double-walled cup is realised in a more stable manner.

The object is solved by the features of claim 1.

According to the invention a double-walled cup of this nature is characterised in particular in that the inner cup providing the inner wall is inserted into an outer cup providing the outer wall and is attached to it in particular in a detachable manner and the inner cup is formed at least from a fluid-tight plastic material.

Through the use of an inner cup and an outer cup, the structure of the double-walled cup is more mechanically stable, because a sleeve open at the bottom is omitted, which is pushed onto the inner cup from below. If the inner cup has a leak, this does not lead to a leak in the double-walled cup by means of which a user's clothes may become dirty. Instead, the outer cup provides a catchment method for a leak of this nature in the inner cup, so that the double-walled cup according to the invention is not only more stable, but rather is also safer in use.

The inner cup can be arranged in the outer cup in various ways and can be attached in it or to it. Through the use of two cups many methods are available for the detachable attachment, such as for example in the region of the inner and outer walls, in the region of optionally available edges of both cups and/or also in the region of the bottom parts of both cups. In addition the manufacture of the inner cup is simplified, because it is formed from a plastic material and can be manufactured in various designs and variations by appropriate plastic moulding techniques and can then be simply inserted into the outer cup.

This appropriate plastic material of the inner cup is at least fluid-tight, so that with the use of pourable or liquid content, the inner cup is adequately sealed.

In order to improve the protective capability of the outer cup in particular with a leak of the inner cup or with the passage of the foodstuff or the like contained in the inner cup into the outer cup and similarly design it at least fluid-tight, the outer cup can be coated inside and/or outside with a fluid-tight plastic film. This plastic film can, in particular with the coating of the outer cup on the outside, improve the printing capability of the outer cup, wherein already a relatively good printing capability is ensured by the use of paper, cardboard or the like for the outer cup.

In order to improve the removal in particular of a liquid foodstuff from the double-walled cup, the outer cup can have an outwardly protruding edge flange at least partially surrounding an appropriate upper outer cup opening. In this way the outer cup is not only stabilised in its shape in particular in the region of the outer cup opening, but rather also drinking a liquid foodstuff from the cup is simplified. In an advantageous embodiment the corresponding edge flange can be formed as a rolled rim which is beaded outwards. The appropriate plastic film can also be applied in the region of this rolled rim.

In order to also simplify the removal from the inner cup or optionally to provide an upper seal of the inner cup with respect to the outer cup, the inner cup can have at least partially an inner edge flange surrounding its upper inner cup opening. This can be formed in various ways depending on requirements.

In an advantageous embodiment the inner edge flange can at least in places contact the outer edge flange of the outer cup from above. In this way removal of the in particular liquid foodstuff from the double-walled cup is possible via both of the edge flanges which are in contact with one another. In addition a very simple and adequate sealing of the inner cup with respect to the outer cup is provided in the region of the edge flanges.

In order to improve the sealing and to already, for example, achieve a certain attachment of the inner cup with respect to the outer cup or at least a fixing in the relative position, the inner edge flange can at least partially circumferentially grip the outer edge flange. The circumferential gripping effect can be realised in various ways. In one embodiment the outer edge flange is relatively loosely gripped circumferentially by the inner edge flange so that the mutual support of the edge flanges essentially only serves the positioning of the inner cup in the outer cup. There is similarly the possibility that the circumferential gripping occurs relatively tightly so that essentially a frictionally engaged joint is provided in this region which already facilitates a certain and optionally also adequate fixing of the inner cup in the outer cup. In this connection, in order to improve the fixing, the inner edge flange and the outer edge flange can be joined together in particular detachably. A joint of this nature can be established by a suitable adhesive or also for example by fusing and joining with the plastic film applied to the outer cup in the region of the edge flanges.

Of course, in addition to a joint of this nature in the region of the edge flanges, a further joint by adhesive, fusing of the plastic film or the like can also occur in the region of the inner and outer walls of the inner and outer cups or in the region of the corresponding bottom parts of both cups additionally or also alternatively.

In particular when using a rolled rim circumferentially flanged outwards on the outer cup it may prove to be advantageous if the inner edge flange is formed with an inverse U-shape and with the inner cup inserted the rolled rim circumferentially grips from above by means of the corresponding U-limbs.

Then the corresponding detachable attachment of both cups can also occur by means of the U-limbs and the rolled rim. A frictionally engaged joint may be adequate in this connection.

There is also the possibility that the inner edge flange is formed essentially as a flat edge flange protruding radially outwards, which for example essentially only contacts the outer edge flange or the rolled rim from above. Here, there is the possibility that a flat edge flange of this nature protrudes radially over the outer edge flange and forms for example a drip edge in its free end.

In another embodiment of the invention the inner edge flange can be placed on a shoulder protruding at least in places from the inner side of the outer cup, in particular when formed as a flat edge flange. In this way the upper inner cup opening is arranged offset downwards with respect to the upper outer cup opening and the inner cup is completely accommodated by the outer cup. An appropriate attachment and/or sealing between the inner cup and outer cup can occur through the support of the inner cup flange on the corresponding shoulder, wherein in this region a detachable attachment can also occur via adhesive, fusing of plastic film or the like applied to the outer cup.

Instead of supporting the inner edge flange on a shoulder of this nature, with a further embodiment the inner edge flange which is in particular formed as a flat edge flange can be inserted with its free end in a groove running around the inner side of the outer cup. Both by supporting on the shoulder and also by insertion into the groove, the corresponding relative position of the inner cup is defined in relation to the outer cup. The engagement of the free end in the groove can in particular provide a positively locked joint of both cups, wherein a certain latching effect is established by the engagement of the free end in the groove on inserting the inner cup into the outer cup. Also in this connection the appropriate attachment or sealing can occur in the region of the free end and the groove, with in turn adhesive, fusing of the plastic film on the outer cup or the like.

The insertion of the inner cup using a shoulder or a groove is at least with the use of the groove thus simplified in that it has a depth which is less than the length of the flat edge flange. This can however similarly apply in the region of the shoulder so that also its depth is less than the length of the flat edge flange. In this way manufacture of the appropriate shoulder or groove is simplified, because it can be formed in the outer cup with little expense and without significantly affecting its outer visible side.

In particular with the formation of a groove, the insertion of the free end of the flat edge flange and sealing in this region can be improved in this way if optionally the flat edge flange is rounded off at its free end.

There is the possibility that the outer cup is conically extended upwards at its upper end in an appropriate upper wall section between the outer cup opening and the shoulder. In this way the arrangement of the inner cup and in particular of the flat edge flange with the shoulder is simplified. However, in this connection to improve the fixing of the inner cup in the outer cup, the corresponding wall section of the outer cup can extend from the shoulder upwards essentially vertically to the corresponding outer edge flange.

In a further embodiment according to the invention the inner cup can end with its lower end or bottom part spaced to the lower end or bottom part of the outer cup with the formation of an accommodation space between these ends or bottom parts. This accommodation space can be used to accommodate a surprise present or the like, which is accessible in particular after emptying the inner cup and its removal from the outer cup. There is however also the possibility that the lower end or the bottom part of the inner cup is in contact with the lower end or bottom part of the outer cup, so that the inner cup is not just supported by contact with the corresponding edge flanges, but rather also through contact with the corresponding bottom parts in the outer cup. In addition in this connection, attachment of both cups can occur also in the region of the bottom parts or lower ends. With an accommodation space of only small size it may also provide thermal insulation, because direct contact in this region between the inner cup and outer cup is avoided.

The thermal insulation between the inner and outer cups can be improved in that between at least the inner cup wall and the outer cup wall an air chamber is formed in particular running in the circumferential direction. There is also the possibility that a large number of air chambers of this nature can be arranged in the circumferential direction, which are interrupted by appropriate supporting ribs, supporting protrusions or the like between both cups. The corresponding air chambers can in this connection both extend in the vertical direction and be separated from one another in the circumferential direction and/or extend in the circumferential direction and be separated from one another in the vertical direction.

For the cross-sections of the cups various geometrical shapes are conceivable, such as circular, oval, rectangular and in particular square. In order to simplify holding the double-walled cup, the inner cup wall and the outer cup wall can extend upwards conically. Various relationships are possible for the appropriate cone angle for the inner cup wall and outer cup wall. Direct contact between the inner and outer walls is for example then possible when the cone angle of the inner cup wall and the outer cup wall are equal. However, for an equal cone angle a constant spacing between the inner and outer walls can also be present if for example the arrangement of the inner cup in the outer cup occurs using the shoulder or the groove. Similarly there is the possibility that the cone angle of the inner cup wall and the outer cup wall are different. In one embodiment the cone angle of the outer cup wall is larger than the cone angle of the inner cup wall so that a spacing between the inner and outer cup walls increases in the direction of the cup opening. Also the inverse case is possible, i.e. a cone angle of the inner cup wall is larger than a cone angle of the outer cup wall so that the spacing between both increases in the direction of the bottom of the cup.

It has already been pointed out that the appropriate attachment of the two cups can take place at different points. If this attachment is for example to also occur in the region of the cup walls, it may be regarded as advantageous if the inner cup wall contacts the outer cup wall inside at least in places.

The appropriate plastic material of the inner cup not only improves its sealing properties, but also its service life. In addition, a plastic material of this nature can also be formed gas tight in a simple manner or it in any case features appropriate sealing with respect to gas as well as with respect to liquid. In this way sensitive foodstuffs, such as yoghurt, biscuit, or the like are better protected against odours or other gases. In a similar way an emission of an odour or a gas from the double-walled cup is prevented if it contains for example cheese or another strongly smelling foodstuff.

Closure of the double-walled cup can be achieved in various ways. For example a lid can be placed in a known manner on the corresponding edge flange of the outer cup or inner cup. There is also the possibility of detachably attaching a sealing foil for closing the inner cup to the inner or outer edge flange.

In principle there is also the possibility that the inner cup has a different geometrical shape than the outer cup apart optionally from the region of the edge flanges that are in contact with one another or in the region where the inner edge flange is arranged on the shoulder or in the groove. Thus an oval or rectangular inner cup can also be arranged for example in an outer cup with a round cross-section or vice versa. The appropriate positioning of the cups relative to one another or also their attachment can then only occur in the region of the geometrical similar edge flanges or by contact of the inner edge flange on the shoulder or in the groove.

For reasons of a simplified arrangement of the two cups it may however be advantageous if the cross-sections of the inner and outer cups are essentially geometrically similar to one another over the complete height of the double-walled cup.

Referring to the above description, it may also be of advantage if the inner cup stands at least in places on a bottom part of the outer cup at its lower end. In this way the positioning of the inner cup is supported in the outer cup and furthermore in the region of this support a detachable attachment of both cups can also occur. If the support is only provided in places, the remaining region can also provide thermal insulation.

It is also pointed out that thermal insulation with the double-walled cup according to the invention also can only occur through the outer cup formed out of paper, cardboard or the like, even if in particular the inner cup wall is in contact with the outer cup wall from the inside. There is here the possibility that the outer cup has a sufficient material thickness in the region of its outer cup wall or it is formed for example double-walled with optionally air chambers arranged between the walls.

A plastic material for the inner cup which is both fluid and also gas-tight is for example polypropylene, polystyrene, polyester, polyethylene, a combination of these materials or the like.

It has already been pointed out that the connection between the inner and outer walls can occur in various ways, wherein in particular a connection by means of the plastic film applied to the outer cup can be provided by polyethylene.

In connection with the accommodation space mentioned above for accommodating a surprise present it may furthermore prove to be advantageous if it can also be removed already before the emptying of the inner cup and without releasing the inner cup from the outer cup. This can be realised for example in that a lower cup section of the outer cup is detachable from the upper cup section.

A possibility of providing a detachable capability of this nature between the cup sections is through the formation of a tear-off strip or tear-off line between these cup sections.

The tearing off of the strip or line can be simplified if a tear-off tab protrudes or at least a tear-off tab of this nature is joined to the strip or line and for example can be folded out of the outer surface of the outer cup.

Figure 2:
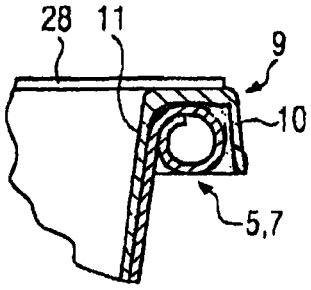
Figure 3:
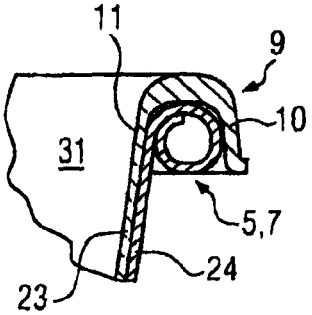
Figure 4:
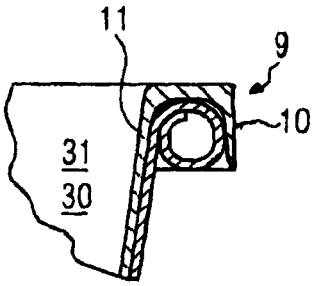
Figure 5:
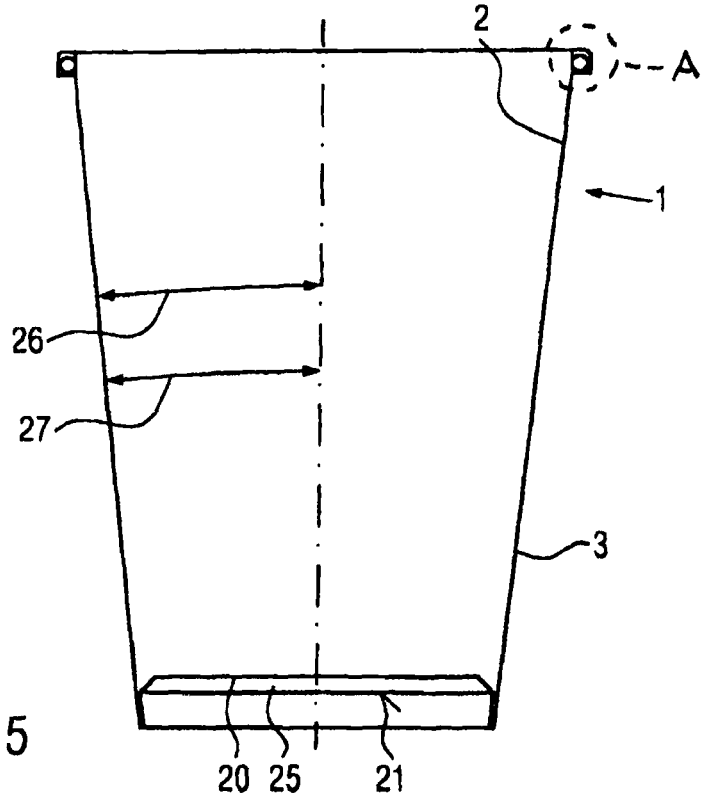
Figure 6:
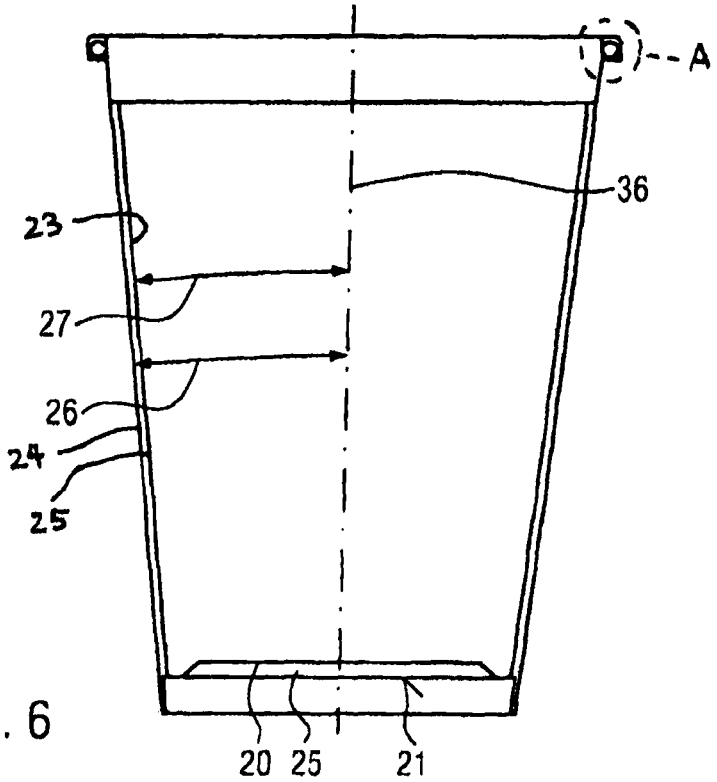
Figure 8:
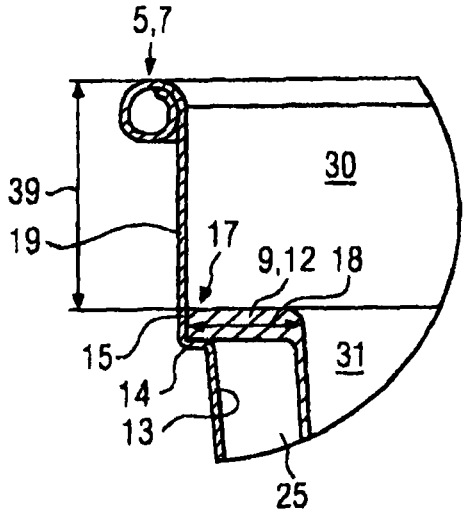
Figure 7:
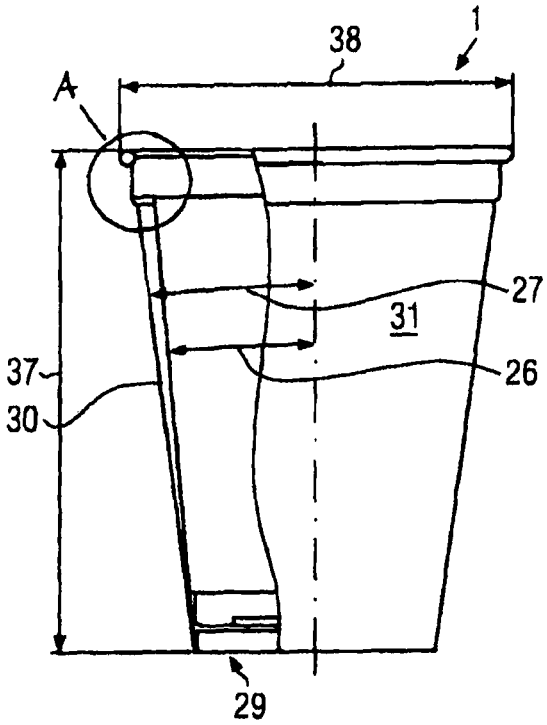
Figure 10:
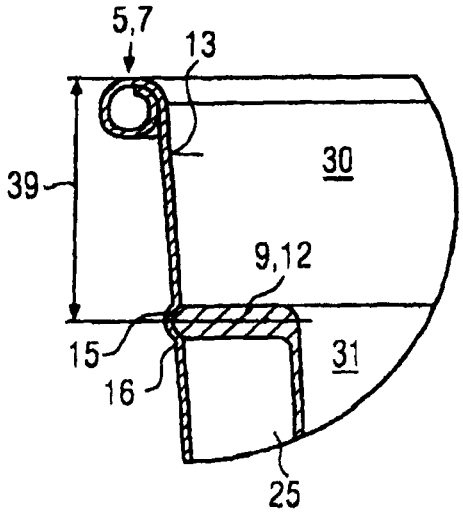
Figure 9:
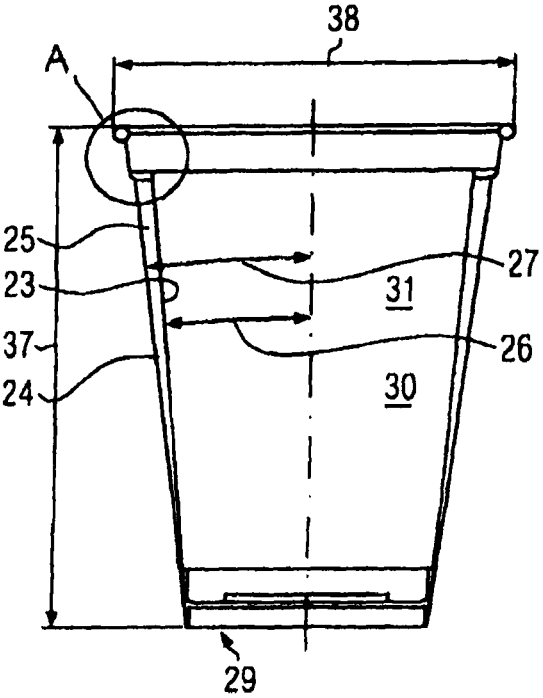

Advantageous embodiments of the invention are given in the figures included in the drawings. The following are shown:

FIG. 1 a longitudinal section through a first embodiment of a double-walled cup;

FIG. 2 an enlarged illustration of a detail "A" of FIG. 1;

FIG. 3 an illustration analogous to FIG. 2 for a further embodiment;

FIG. 4 an illustration analogous to FIG. 2 for another further embodiment;

FIG. 5 a longitudinal section through a second embodiment of a double-walled cup according to the invention;

FIG. 6 a longitudinal section through a third embodiment of a double-walled cup according to the invention;

FIG. 7 a longitudinal section through a fourth embodiment of a double-walled cup according to the invention;

FIG. 8 an enlarged illustration of a detail "A" of FIG. 7;

FIG. 9 a longitudinal section through a fifth embodiment of a double-walled cup according to the invention; and FIG. 10 an enlarged illustration of a detail "A" of FIG. 9.

FIG. 1 shows a longitudinal section through a first embodiment of a double-walled cup 1 with an inner cup 2 and an outer cup 3. The inner cup 2 is arranged spaced with its lower end 20 to the lower end 21 of the outer cup 3, wherein this lower end 21 is formed by a bottom part 29. Between the ends 20, 21 an accommodation space 22 is formed which also serves as an air chamber 25 for the thermal insulation between the two cups 2, 3. A surprise present 40 is arranged within the accommodation space 22. Access to the accommodation space 22 is obtained by tearing off a tear-off strip 34 which is formed between an upper cup section 33 and a lower cup section 32 of the outer cup 3. The tear-off strip 34 has a tear-off tab 35 which can be grasped for tearing off.

The inner and outer cups 2, 3 each have at the upper end an appropriate upper inner or outer cup opening 8, 6. This is closed off in FIG. 1 by a sealed-on sealing foil 28. The sealing foil 28 is sealed on in the region of an inner edge flange 9. This inner edge flange 9 protrudes outwards from the inner cup 2 and surrounds the corresponding inner cup opening. On the inside 31 of the inner cup 2 a consumable foodstuff can be arranged and after removal of the sealing foil 28 or also of a corresponding lid it can be removed from the double-walled cup 1.

Below the corresponding inner edge flange 9 an outer edge flange 5 is arranged in the form of a rolled rim 7 which is beaded outwards. This outer edge flange 5 is arranged on the upper end of the outer cup 3 and surrounds its upper outer cup opening 6.

Accordingly in FIG. 1, the inner wall or inner cup wall 23 formed by the inner cup 2, refer also to the following embodiments, and the outer wall or outer cup wall 24 formed by the outer cup 3, refer also to the following embodiments, are in contact, wherein no air chamber is formed between them and the thermal insulation is achieved through the outer cup 3 and its material, such as paper, cardboard or the like.

The inner and outer cups 2, 3 are conically extended in the direction of the respective cup opening, wherein the corresponding cone angles, refer also to the following embodiments, are equal in this case.

In the following FIGS. 2 to 4 various embodiments for detail "A" according to FIG. 1 are illustrated enlarged. In these figures as with all other figures the same parts are in each case identified with the same reference numerals and are sometimes only mentioned in conjunction with a figure.

In FIG. 2 it can be seen that the sealing foil 28 is applied from above onto a flat region of the inner edge flange 9 where it is attached sealed. The inner edge flange 9 has an inverse U-shape with two U-limbs 10 and 11 pointing downwards. These overlap the outer edge flange 5 from above which is formed as the rolled rim 7. Here, the outer U-limb 10 is spaced, forming a free space, relative to the outer side of the rolled rim 7. The inner U-limb 11 and the connection of the U-limbs are in each case in contact with the rolled rim 7 or the outer cup wall 24.

In the embodiment of FIG. 3 the respective U-limbs 10, 11 are in close contact with the rolled rim 7 so that essentially a frictionally engaged joint is formed through the contact of the outer edge flange 5 and the inner edge flange 9.

This applies analogously also to the embodiment of FIG. 4, wherein it has two U-limbs of approximately equal material strength, whereas in the embodiment according to FIG. 3 the outer U-limb 10 has a greater material thickness than the inner U-limb 11. In both embodiments according to FIGS. 3 and 4 the connection of the U-limbs 10 and 11 is in each case formed with a greater material thickness than the U-limbs.

In FIG. 5 a second embodiment of a double-walled cup is illustrated. This differs from the embodiment according to FIG. 1 essentially in that the inner cup 2 extends with its lower end 20 to the lower end 21 of the outer cup 3. The lower end 20 of the inner cup 2 is thus so formed that the inner cup 2 in some places stands on the corresponding bottom part 29 and an air chamber 25 is formed between them.

The corresponding cone angles 26 of inner cup 2 and 27 of outer cup 3 are each equally large, wherein between the inner cup wall 23 and outer cup wall 24 no further free space is formed for an air chamber or the like, but rather both cup walls are in contact over their complete height.

In the third embodiment according to FIG. 6 the cup walls 23, 24 are arranged spaced from one another at least over the greatest part of their longitudinal extent, wherein an air chamber 25 of essentially equal width is formed due to the equal cone angles 26, 27 in the direction perpendicular to the verticals 36.

The other features of the third embodiment essentially correspond to those of the first and second embodiments according to FIGS. 1 and 5.

It should be noted that the respective details "A" corresponding to the FIGS. 2 to 4 can be formed for all embodiments described so far.

The attachment of the two cups 2, 3 can on one hand occur in the region of the corresponding edge flange 5, 9. This can for example be realised in that, refer to FIGS. 3 and 4, a frictionally engaged joint is formed between the edge flanges. Additionally or alternatively, an adhesive can be arranged between the edge flanges or also between the inner cup wall 23 and the outer cup wall 24 or between the lower end 20 of the inner cup 2 and the lower end 21 of the outer cup 3 or for the detachable connection of both cups 2, 3 a plastic film 4, refer to FIG. 1, applied to the inner side and optionally also to the outer side of the outer cup 3 can be briefly melted and then joined to the inner cup 2 at the appropriate point. The joint via the plastic film can of course also occur in the region of the corresponding edge flange 5, 9.

There is similarly the possibility that the cone angles 26, 27 in the embodiments according to FIGS. 1, 5 and 6 are different, refer for example also to the fifth and sixth embodiments according to FIGS. 7 and 9. Here, the cone angle 26 of the inner cup can be smaller than the corresponding cone angle 27 of the outer cup or also vice versa. Due to different cone angles a corresponding air chamber 25 is also produced between the inner cup wall 23 and the outer cup wall 24, refer again to FIGS. 7 and 9.

The fourth embodiment according to FIG. 7 differs from the embodiments due to a different positioning and formation of the inner edge flange 9. This is formed as the flat edge flange 12, refer also to FIG. 8, which is an enlarged illustration of the detail "A" from FIG. 7. This flat edge flange 12 lies with its underside and its free end 15 on a shoulder 14 which is formed on an inner side 13 of the outer cup 3. Above the shoulder 14 a wall section 19 of the outer cup wall 24 extends over a height 39. This wall section 19 extends essentially parallel to the verticals 36 up to the rolled rim 7 as the outer edge flange 5. A corresponding depth 17 of the shoulder 14 is less than a length 18 of the flat edge flange 12, with which it is spaced radially outwards from the inner cup 2 in the region of the inner cup opening 8. In this way an appropriate air chamber 25 is formed between the inner cup wall 23 and the outer cup wall 24, refer also to FIG. 7, which due to the different cone angles 26, 27 is formed with a width reducing in the direction of the bottom part 29 of the outer cup 3.

For the fourth embodiment according to FIG. 7 as well as for the other embodiments, the inner cup 2 can also be formed according to FIG. 1, i.e. spaced to the bottom part 29 of the outer cup 3. Furthermore, with this embodiment as well as with the other embodiments there is the possibility that an appropriate shoulder is formed on the inner side of the inner cup 2, which for example, with double-walled cups 1 inserted into one another serves as a destacking aid, wherein a shoulder of this nature prevents the stacking depth of cups of this nature being too large, leading to jamming of the cups with one another.

Also in the embodiments according to FIGS. 5, 6, 7 and 9 there is the possibility of arranging an appropriate surprise present 40 in the accommodation space 22, when the inner cup 2 terminates sufficiently spaced to the bottom part 29 of the outer cup 3.

There is similarly the possibility that for example in the embodiment according to FIG. 7 the depth 17 of the shoulder 14 essentially matches the length 18 of the flat edge flange 12 and the air chamber 25 is formed such that the cone angle 26 of the inner cup 2 is larger than the cone angle 27 of the outer cup 3. In this way an air chamber 25 is formed which has an increase in width in the direction of the bottom part 29.

In the embodiments according to FIGS. 7 and 9, the inner cup 2 is in each case completely positioned in the inside 30 of the outer cup 3, whereas in the embodiments according to FIGS. 1, 5 and 6 it protrudes at least with its inner edge flange 9 from the inside 30 of the outer cup 3.

In the fifth embodiment according to FIG. 9 the flat edge flange 12 is fixed as the inner edge flange 9 of the inner cup 2 in a different place and manner to the outer cup 3. Here, the outer cup 3 has a groove 16 on its inner side 13 spaced to the rolled rim 7, in which the free end 15 of the flat edge flange 12 is inserted. This free end 15 can here be formed rounded off for improved fitting and accommodation with respect to the groove 16.

The remaining features of the fifth embodiment correspond to the fourth embodiment according to FIG. 7. Appropriate alternatives of the embodiments are in turn possible, refer for example to the different cone angles 26, 27 or the spaced end of the inner cup 2 with respect to the bottom part 29 of the outer cup 3. Also the relation of the cone angles 26, 27 can be inverted, i.e. the cone angle 26 of the inner cup can be larger than the cone angle 27 of the outer cup 3.

Also in the embodiment according to FIGS. 9 and 10 a corresponding depth of the groove 16 is lower than a length 18 of the flat edge flange 12. There is however similarly the possibility that the depth essentially corresponds to the length so that in the region of the groove 16 the corresponding cup walls 23 and 24 are in contact and a corresponding air chamber 25 is formed with increasing width in the direction of the bottom part 29.

In FIGS. 7 and 9 the total height 37 of the double-walled cup 1 is still provided, which here is determined by the height of the outer cup 3. In FIGS. 1, 5 and 6 approximately the thickness of the joint of the two U-limbs 10, 11, refer to FIGS. 2 to 4, is added in each case to the total height of the outer cup 3 in order to obtain the total height 37 of the double-walled cup 1.

The corresponding diameter 38 of the cup opening is in the embodiment according to FIGS. 7 and 9 determined by the diameter 38 of the outer cup 3, wherein this is determined in FIGS. 1, 5 and 6 by the corresponding diameter of the inner cup 2 in this region.

It should be noted that other methods for the outer and inner edge flanges are possible. One possibility is for example that the inner edge flange 9 is formed as an outwardly beaded rolled rim, which engages from above into a U-shaped outer edge flange 5 open at the top. Similarly there is the possibility that instead of a flat edge flange 12 in FIG. 10 a rolled rim is formed as the inner edge flange 9, which correspondingly engages the groove 16.

Other variations and combinations of the various embodiments according to the invention are possible, such as for example also a further shoulder in the outer cup 3, on which the lower end 20 of the inner cup 2 is supported.

The inner cup is formed from a gas and fluid-tight plastic material such as polypropylene, polystyrene, polyester, polyethylene or a combination of these materials and can be produced according to appropriate plastic moulding techniques in a simple and rapid manner. Through the use of a material of this nature the inner cup is also sufficiently strong and has an adequately long service life.

Through the use of paper, cardboard or the like for the outer cup it can be easily printed on its outer side, wherein this printing capability can be improved further by a plastic film of, for example, polyethylene applied appropriately to the outer side.

The invention claimed is:

1. A double-wall cup comprising:

an inner wall and an outer wall, an upper cup opening and a lower cup bottom, at least the outer wall is essentially formed from paper or cardboard, the inner wall is formed by an inner cup, which is inserted into an outer cup providing the outer wall, the inner cup being detachably attached in the outer cup, the inner cup is formed from an at least fluid-tight plastic material, the inner cup terminates with its lower end spaced apart from a lower end of the outer cup such that an accommodation space exists between the lower end of the inner cup and the lower end of the outer cup and the lower end of the inner cup does not contact the lower end of the outer cup, a lower cup section of the outer cup is detachable from an upper cup section of the outer cup without physically compromising the inner cup to provide access to the accommodation space; and wherein a tear-off strip or a tear-off line is formed on a side wall of the outer cup between the lower cup section and the upper cup section and runs circumferentially around an outer wall surface of the outer cup and wherein the outer cup has an outer edge flange which protrudes outwards and at least partially surrounds the upper outer cup opening, and wherein the inner cup has an inner edge flange which at least partially surrounds an upper inner cup opening, wherein the inner edge flange comprises two limb portions that each extend downward from a connective portion, and wherein the entire connective portion is thicker along a horizontal direction than each of the two limb portions along a vertical direction.

2. A double-walled cup comprising:

an inner cup having an inner cup side wall and an inner cup bottom, the inner cup being formed from a fluid-tight plastic material;

an outer cup having an outer cup side wall and an outer cup bottom, the outer cup being essentially formed from paper or cardboard wherein the inner cup is detachably coupled to and substantially positioned within the outer cup, and wherein the inner cup bottom does not contact the outer cup bottom;

an accommodation space between the inner cup bottom and the outer cup bottom;

a surprise present contained inside the accommodation space;

a tear-off strip in the outer cup formed on the outer cup side wall between an upper and lower section of the outer cup, wherein the tear-off strip runs circumferentially around an outer wall surface of the outer cup, and wherein the tear strip is arranged such that tearing the tear-off strip separates the lower section of the outer cup from the upper section of the outer cup to provide access to the surprise present in the accommodation space without physically compromising the inner cup and wherein the outer cup has an outer edge flange which protrudes outwards and at least partially surrounds the upper outer cup opening, and wherein the inner cup has an inner edge flange which at least partially surrounds an upper inner cup opening, wherein the inner edge flange comprises two limb portions that each extend downward from a connective portion, and wherein the entire connective portion is thicker along a horizontal direction than each of the two limb portions along a vertical direction.

3. The double wall cup of claim 1 wherein the inner cup is manufactured from polypropylene, polystyrene, polyester, polyethylene, or any combination of these materials.

4. The double-wall cup according to claim 1 wherein the tear-off strip has a tear-off tab that can be grasped by a user to facilitate tearing the tear-off strip.

5. The double-wall cup according to claim 1, wherein the inner cup and the outer cup are joined together by an adhesive or by mechanical interaction.

6. The double wall cup of claim 2 wherein the inner cup is manufactured from polypropylene, polystyrene, polyester, polyethylene, or any combination of these materials.

7. The double-walled cup of claim 2 wherein the surprise present substantially fills the accommodation space.

8. The double-walled cup according to claim 2, wherein a tear-off tab is joined to the tear-off strip.

9. The double-walled cup according to claim 1, wherein a connection between the inner cup and the outer cup is formed with polyethylene applied on an inside of the outer cup.

10. The double-walled cup according to claim 2, wherein a sealing foil or a lid for sealing the inside of the cup is detachably attached to the inner edge flange or the outer edge flange.

11. The double-walled cup according to claim 2, wherein the inner cup comprises a gas-tight plastic material.

12. The double-walled cup according to claim 1, wherein the inner cup comprises a gas-tight plastic material.

13. The double-walled cup according to claim 2, wherein an air chamber running in the circumferential direction is formed between at least the inner cup side wall and the outer cup side wall.

14. The double-walled cup according to claim 2, wherein the inner edge flange and the outer edge flange are detachably joined together.

15. The double-walled cup according to claim 2, wherein the inner edge flange contacts the outer edge flange from above at least in places.

16. The double-walled cup according to claim 2 wherein the inner edge flange encompasses the outer edge flange at least partially.

17. The double-walled cup according to claim 2, wherein the outer cup has an outer edge flange which protrudes outwards and at least partially surrounds the upper outer cup opening.

18. The double-walled cup according to claim 2, wherein the outer edge flange is formed as a beaded rolled rim.

19. The double-walled cup according to claim 2, wherein a connection between the inner cup and the outer cup is formed with polyethylene applied on an inside of the outer cup.

20. The double-walled cup of claim 2 wherein a surprise present substantially fills the accommodation space.

21. The double-walled cup according to claim 1, wherein an air chamber running in the circumferential direction is formed between at least an inner cup side wall and an outer cup side wall.

* * * * *